United States Patent [19]

Markley

[11] 4,326,444

[45] Apr. 27, 1982

[54] MUSICAL INSTRUMENT STRING

[76] Inventor: Donald D. Markley, 2610 Northwood Dr., San Jose, Calif. 95132

[21] Appl. No.: 151,147

[22] Filed: May 19, 1980

[51] Int. Cl.[3] ..... G10D 3/10

[52] U.S. Cl. ..... 84/297 S; 84/267

[58] Field of Search ..... 84/297 S, 199, 267

[56] References Cited

U.S. PATENT DOCUMENTS

| | | | |
|---|---|---|---|
| 2,049,769 | 8/1936 | Gray | 84/199 |
| 2,205,144 | 6/1940 | Kaplan | 84/297 S |
| 2,241,282 | 5/1941 | Wackerle | 84/297 S |
| 2,641,949 | 6/1953 | Jensen | 84/297 S |
| 2,746,335 | 5/1956 | Johnson | 84/199 |
| 2,762,251 | 9/1956 | Infeld | 84/199 |

FOREIGN PATENT DOCUMENTS

| | | | |
|---|---|---|---|
| 1264160 | 5/1961 | France | 84/297 S |

OTHER PUBLICATIONS

*The Music Trades,* "Introducing D'Addario Half Round", Jun. 1976, p. 70.

*Primary Examiner*—L. T. Hix
*Assistant Examiner*—Alan Mathews
*Attorney, Agent, or Firm*—Claude A. S. Hamrick

[57] ABSTRACT

A musical instrument string having a central core and one or more lengths of wire forming helically wound layers along the length. The outer surface of the string is unaltered from one end to a mid area and from the mid area to the other end of the string, the string has a smooth outer surface.

11 Claims, 5 Drawing Figures

MUSICAL INSTRUMENT STRING

BACKGROUND OF THE INVENTION

1. Field of the Invention

The present invention relates generally to musical instrument strings and more particularly, to an improvement in wound strings of the type used on base guitars and the like.

2. Background of the Invention

Base strings for the various types of guitars require a larger mass than the higher note strings and have long been manufactured by helically winding one or more coils of relatively light gauge wire about a center wire in order to provide a string which is flexible enough to provide clear, crisp ringing sounds.

One of the problems with such strings, however, is that the helical grooves formed between each turn of the outer winding generate noise as the player's fingers slide along the string and cause excessive fret and neck wear as the string surface is pressed into engagement therewith.

An attempt to overcome this problem has been to either grind the surface of the outer winding to produce a "ground round wound" string. Another solution has been to utilize a wire having a rectangular cross section as the outer winding of the string to provide what is known as a "flat wound" string.

Although these solutions offer definite improvements over the round wound configuration, grinding of the entire length of wire reduces the ability of the string to accurately reproduce high notes within its range and using the flat wound configuration substantially increases the cost of the string.

SUMMARY OF THE PRESENT INVENTION

It is therefore an objective of the present invention to provide a novel base string configuration in which only the surface of the fingered portion of the string is modified.

Another object of the present invention is to provide a method of modifying the fingered portion of a round wound base string without materially detracting from the tonal quality of the string.

Briefly, a preferred embodiment of the present invention includes a round wound base string in which the diameter of the portion extending from at least the nut to the 14th fret is reduced by grinding or coining so as to have a substantially smooth surface.

An important advantage of the present invention is that is provides a base string which can be made by modifying a standard round wound base string.

Another advantage of the present invention is that only the surface portion of the string which is to be fingered is modified.

These and other objects and advantages of the present invention will no doubt become apparent to those skilled in the art after having read the following detailed description of the preferred embodiments which are illustrated in the several figures of the drawing.

IN THE DRAWING

DETAILED DESCRIPTION OF THE PREFERRED EMBODIMENTS

Figure 1:
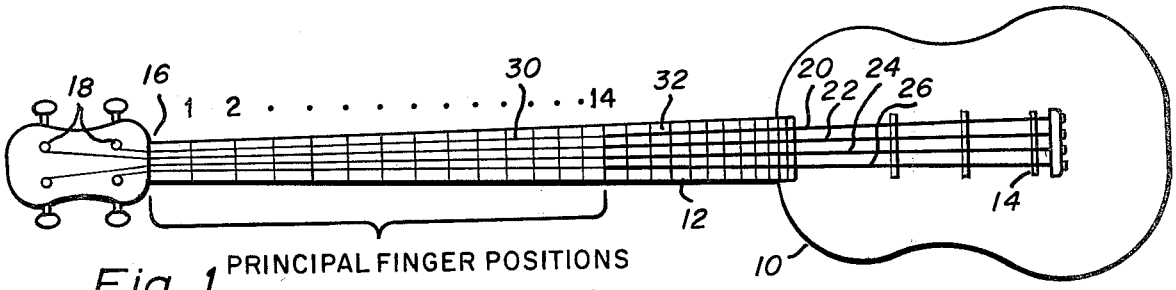
FIG. 1 is a plan view showing a four string base guitar having strings in accordance with the present invention.
Figure 2:
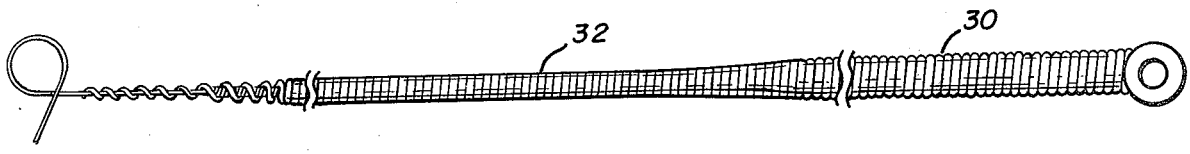
FIG. 2 is a plan view illustrating an improved base guitar string in accordance with the present invention.

Referring now to FIG. 1 of the drawing, there is shown a plan view of a four string base guitar having a body 10, a neck 12, a bridge 14, a nut 16 and string tightening pegs 18. Strung on the guitar are four round wound base strings 20, 22, 24 and 26 which are thicker in diameter from the bridge end to a point proximate the 14th fret and are of reduced cross-sectional area from the 14th fret to the nut end of the string. Such a string is more clearly illustrated in FIG. 2 wherein the normally round wound portion is illustrated at 30 and the modified portion of lesser diameter is illustrated at 32. The reduction in cross-section is somewhat exaggerated for purposes of illustration. Note that whereas the round wound portion 30 has a rippled surface caused by the external configuration of the windings, the surface of the portion 32 is smooth due to a modification of the outer surface of the string windings.

Figure 3:
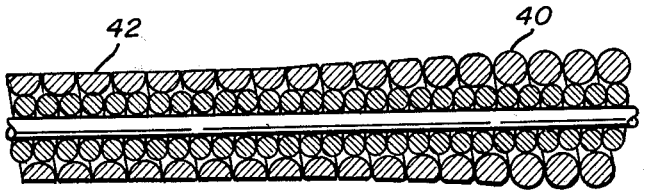
FIG. 3 is an enlarged longitudinal cross-section showing the transitional portion of a base guitar string in accordance with a first embodiment of the present invention.

In FIG. 3, one method of modifying a round wound string in accordance with the present invention is illustrated. In accordance with this method, the outer surfaces of the outer windings 40 are merely abraded or ground away so as to leave approximately $\frac{2}{3}$ to $\frac{1}{2}$ of the diameter of the string remaining, thereby providing a relatively smooth and continuous surface as illustrated at 42. Although this technique for modifying the strings is workable, the fact that it removes some of the mass of the modified portion of the string tends to cause a slight, though almost unnoticeable, variation in the sound characteristics of the string.

Figure 4:
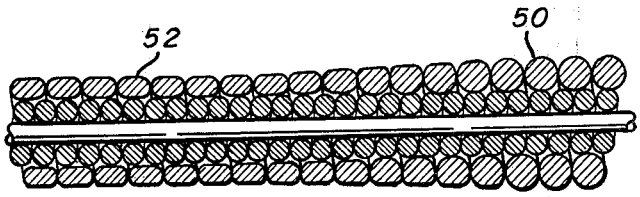
FIG. 4 is an enlarged longitudinal cross-section showing the transitional portion of a base guitar string in accordance with a second embodiment of the present invention.
Figure 5:
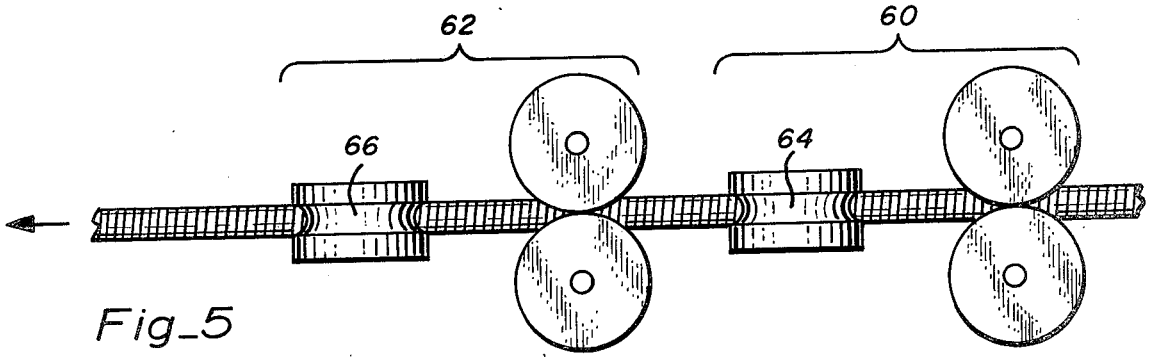
FIG. 5 is a diagram schematically illustrating apparatus for coining a portion of a base guitar string in accordance with the present invention.

An alternative method of modifying a portion of a ground wound string 50 is illustrated in FIG. 4 and includes coining the surface portion to be modified as shown at 52. The reslt of the coining operation is to deform the outer winding from a round cross-sectional configuration into a generally rectangular or oval configuration as shown. As used herein, the word "coining" means to compress the surface of the string radially inwardly by means of coining wheels, such as are illustrated in FIG. 5, and thereby smooth out the surface of the string without abrading away or otherwise removing mass from the outer winding.

In accordance with one coining method, the string end is pulled through two sets of coining wheels 60 and 62 which progressively distort the outer surface of the outer windings until the desired outer surface configuration is realized. In the usual case, the coining wheels 60 would have annular coining grooves 64 with diameters slightly smaller than the normal outer surface diameter of the round wound string while the set of wheels 62 would have annular coining grooves 66 with diameters slightly less than those of wheels 60. As a result, the outer surface of the string to be modified would be progressively flattened as it passed through wheels 60 and then wheels 62. In some cases, involving particularly the larger diameter strings, it may be necessary to separately pass the portion of the string to be modified through a series of separate coining wheel pairs of progressively reduced diameters in order to achieve the desired results.

Although two methods have been disclosed for smoothing the surface of a portion of a base guitar string in accordance with the present invention have been disclosed, it is anticipated that other methods will become apparent to those skilled in the art. For example, the modification of the outer winding might even be accomplished prior to its being wrapped about the core and/or core windings so that when the outer winding is completed, it will have a configuration similar to that illustrated in FIG. 4. This could be achieved by drawing one half of the length of winding stock through a forming dye prior to the wrapping operation. It is therfore intended that the following claims be interpreted as covering all such alterations and modifications as fall within the true spirit and scope of the invention.

What is claimed is:

1. A musical instrument string comprising:

means forming a central core for a wound guitar string, the core having a length extending between spaced ends and one or more lengths of wire forming helically wound layers along the length of said central core thereby forming a round wound base string, the outer surface of said base string being unaltered along a first portion of its length extending from one of said ends to a mid area of said length, and a substantial remaining portion of said length extending from said first portion to the other of said ends being modified so as to have a relatively smooth outer surface.

2. A muscial instrument string as recited in claim 1 wherein the surface of said remaining portion is modified by abrading away a portion of the surface thereof.

3. A musical instrument string as recited in claim 1 wherein the surface of said remaining portion is modified by deforming the outer winding so that the external surface is relatively smooth in the direction along the length of the string.

4. A musical instrument string as recited in claim 3 wherein the deformation of the outer winding is accomplished by passing said remaining portion of the string through one or more sets of coining wheels.

5. A muscial instrument string comprising:

means forming a central core; and a length of wire helically wound about said core, approximately one half of said length of wire having a first cross-section configuration and the remaining portion of said length of wire having a second cross-sectional configuration such that a substantial portion of the resulting string has a relatively smooth outer surface along its length.

6. A muscial instrument string as recited in claim 5 wherein said first cross-sectional configuration is round and said second cross-sectional configuration is generally D-shaped.

7. A musical instrument string as recited in claim 5 wherein said first cross-sectional configuration is round and said second cross-sectional configuration is generally oval in shape.

8. In combination with a stringed musical instrument including a body, a neck extending from the body, a nut terminating the neck in spaced relation to said body, bridge means provided on said body and string tightening peg means provided on said nut for cooperating with one another to mount strings extending along said neck, and fret means provided in spaced relation along said neck for permitting the tone of said strings to be changed by selectively pressing said strings against said neck; a musical string comprising a first portion having a round wound outer surface and arranged extending from said bridge, and a second portion having a smooth outer surface and arranged extending from the nut to said first portion and being of a length sufficient to over lay a greater part of said fret means.

9. A combination as defined in claim 8, wherein said first portion has a first diameter and said second portion has a second diameter with the second diameter being less than said first diameter.

10. A combination as defined in claim 8, wherein said fret means includes at least 14 frets spaced parallel to one another along said neck, and said second portion of said muscal string extending from nut to at least the 14th fret of said fret means.

11. A combination as defined in claim 10, wherein said first portion has a first diameter and said second portion has a second diameter with the second diameter being less than said first diameter.

* * * * *